US006145571A

United States Patent [19]

Snyder

[11] Patent Number: 6,145,571

[45] **Date of Patent: *Nov. 14, 2000**

[54] ROLLING BARRIER

[75] Inventor: Ron Snyder, Peosta, Iowa

[73] Assignee: Rite-Hite Holding Corporation, Milwaukee, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 08/937,047

[22] Filed: Sep. 24, 1997

Related U.S. Application Data

[63] Continuation of application No. 08/729,120, Oct. 11, 1996, abandoned.

[51] Int. Cl.[7] ..... A47G 5/02

[52] U.S. Cl. ..... 160/264; 160/1

[58] Field of Search ..... 160/264, 7, 1, 160/310, 10, 120, 311, 312; 192/135, 133

[56] References Cited

U.S. PATENT DOCUMENTS

| | | | |
|---|---|---|---|
| 717,173 | 12/1902 | Cundell . | |
| 848,578 | 3/1907 | Thelin . | |
| 982,105 | 1/1911 | Thomas . | |
| 1,901,073 | 3/1933 | Bailey . | |
| 2,476,792 | 7/1949 | Allen | 160/7 |
| 2,655,067 | 10/1953 | Bechler | 82/34 |
| 2,752,150 | 6/1956 | Richmond et al. | 268/74 |
| 3,292,685 | 12/1966 | Clark | 160/264 X |
| 3,728,057 | 4/1973 | Grundmann et al. | 425/136 |
| 3,803,943 | 4/1974 | Woloszyk | 74/612 |
| 4,088,157 | 5/1978 | Chen et al. | 139/1 |
| 4,160,972 | 7/1979 | La Mell et al. | 160/10 X |
| 4,342,354 | 8/1982 | Leivenzon et al. | 160/133 |
| 4,379,481 | 4/1983 | Juner et al. | 192/135 X |
| 4,502,375 | 3/1985 | Hignite et al. | 98/115.3 |
| 4,593,491 | 6/1986 | Carlson et al. | 49/13 |
| 4,596,162 | 6/1986 | Walter et al. | 74/608 |
| 4,690,195 | 9/1987 | Taylor | 160/310 |
| 4,706,726 | 11/1987 | Nortoft | 160/168.1 P |
| 4,721,946 | 1/1988 | Zunkel | 340/521 |
| 4,800,946 | 1/1989 | Rosenoy | 160/264 |
| 4,849,735 | 7/1989 | Kirtley et al. | 340/539 |
| 4,887,659 | 12/1989 | West | 160/199 |
| 4,887,660 | 12/1989 | Kraus | 160/265 |
| 4,896,714 | 1/1990 | Ellis | 160/264 X |
| 4,934,437 | 6/1990 | Kraeutler | 160/264 X |
| 4,974,658 | 12/1990 | Komatsu et al. | 160/264 X |
| 5,022,452 | 6/1991 | Burrell | 160/7 |
| 5,025,846 | 6/1991 | West | 160/199 |
| 5,198,974 | 3/1993 | Orsat | 160/310 X |
| 5,203,175 | 4/1993 | Farrey et al. | 62/82 |
| 5,295,527 | 3/1994 | West | 160/199 |
| 5,323,831 | 6/1994 | Manthei | 160/264 X |

(List continued on next page.)

OTHER PUBLICATIONS

R. Peter Kiminer; *Declaration of R. Peter Kimener Regarding U.S. Playing Card Installation*; Feb. 6, 1998; 3 pages with Attachments A, B and C.

(List continued on next page.)

*Primary Examiner*—David M. Purol

[57] ABSTRACT

A rolling barrier including a curtain formed of fabric or other material that rolls onto and off of a tube preferably disposed above a doorway or opening to, respectively, block and unblock the opening, the edges of the curtain are received within guideways disposed laterally of the curtain, and which guide the curtain edges to maintain the curtain in a planar orientation during travel; barricade members extending across the curtain (and thus the opening when the barrier is in the closed or blocking position) have their ends disposed in the guideways as well to reinforce the curtain and prevent personnel or objects from passing through the opening at least when the barrier is in the closed position. The barrier may also include a detector for detecting when the door is in or at least approaching the fully closed position and coupled to other electronics to control or regulate operation of the enclosed machine.

8 Claims, 3 Drawing Sheets

U.S. PATENT DOCUMENTS

| | | | |
|---|---|---|---|
| 5,329,781 | 7/1994 | Farrey et al. | 62/82 |
| 5,353,858 | 10/1994 | Hartmann | 160/264 |
| 5,353,859 | 10/1994 | Oltahfer et al. | 160/310 |
| 5,386,891 | 2/1995 | Shea | 188/171 |
| 5,540,269 | 7/1996 | Plumer | 160/310 X |
| 5,552,769 | 9/1996 | Riordan | 160/10 X |

OTHER PUBLICATIONS

R. Peter Kimener; *Declaration of R. Peter Kimener Regarding Procter & Gamble Installation*; Feb. 6, 1998; 3 pages with Attachments A, B, C and D.

Cary Pinkalla; *Declaration of Cary Pinkalla Regarding GM Metal Fabricating Installation*; Feb. 24, 1998; 3 pages with Attachment A.

Author Unknown; Article "Power Curtains Automatic Safety in Robotic Welding Operation"; from *Engineer's Digest*, Oct. 1993; 1 page.

Author Unknown; Article "It's Curtains for Arc Flash in This Robotic–Welding Cell"; from *Welding Design & Fabrication*, Nov. 1993; 1 page.

Author Unknown; Article "Flexibility, Control Are Welding Watchwords"; from *Tooling and Production*, Oct. 1993; 4 pages.

Frommelt Safety Products Corporation; Product Brochure *"Power–Shield™ Automated Safety Curtain"*; Copyright 1993; 4 pages.

Pflow Industries; Product Brochure "*Choosing the Right Vertical Conveyor*"; Copyright 1995; 8 pages.

Freightlift America!; Product Brochure Section "*Understanding ANSI Safety Laws*"; Copyright 1993; 1 page.

Rite–Hite Corporation; 4 pages product information—Description: "*Hydraulic leveler overhead door interlock: Kit Part #04622*"—Drawing #9254 dated Aug. 7, 1977—Drawing #4055 dated Feb. 12, 1988—Output from Rite–Hite Order Processing Database showing shipments of Part No. 04622 in 1991 and 1992 (generated Nov. 11, 1996).

The American Society of Mechanical Engineers; *Safety Standard for Conveyors and Related Equipment: ASME B20.1–1993*; Copyright 1993; 3 pages.

The Conveyor Product Section of The Material Handling Institute; *Application Guidelines for Vertical Reciprocating Conveyors*; Copyright 1991; 5 pages.

Schmersal Safety Interlock Switches; *Machine Guarding Safety Products Catalog AZ–6R*; date unknown; 2 pages.

ROLLING BARRIER

This is a continuation of application(s) Ser. No. 08/729,120 filed on Oct. 11, 1996 now abandoned.

FIELD OF THE INVENTION

The invention is directed generally to safety devices and, more particularly, to a movable barrier for protecting an enclosed work area.

BACKGROUND OF THE INVENTION

Area protection in the vicinity of automated manufacturing machines or in the vicinity of potentially hazardous processes is becoming increasingly important. Area protection is designed to prevent personnel, or even other automated equipment, from intentionally or accidentally entering a work area while a robot or other machine is performing its automatic function. Depending on the machine being enclosed, it may also be important for the area protection to provide a physical barrier between the machine and the surrounding area, as may be the case where an automatic welder is enclosed, and flying sparks and debris need to be contained. Area protection may also provide a barrier to radiation, or heat, or noise generated by the enclosed equipment. At the same time, it is desirable for any area protection system to allow unfettered access to the machine at appropriate time: between cycles, for replenishment of raw materials or work pieces, etc. Of course, area protection may also be used to enclose non-automated processes, such as manual welding stations and the like.

A variety of area protection systems have been used in the past. So-called light curtains comprise an array of photosensitive detectors surrounding a doorway or opening adjacent the automated machine. If the detectors sense the presence of an object (personnel or equipment) in the doorway, operation of the machine may be halted. While this may prevent accidental contact with the operating machine, light curtains do not provide a physical barrier against entry, nor do they offer a physical barrier to debris, sparks, radiation, etc. that may emanate from the enclosed equipment. Pressure-sensitive mats disposed on the floor adjacent a door or other opening near an automated machine serve the same purpose, but are similarly limited. Mechanical gates or barriers are also used. However, these tend to be slow-moving and may prevent visual access to the equipment being enclosed, as well as being relatively expensive. Movable, or portable barriers or screens may also be used, but these must be manually moved whenever access to the enclosed machine or work area is desired.

SUMMARY OF THE INVENTION

The present invention has as its primary object providing an improved area protection device. The rolling barrier according to the invention presents a physical barrier to entry into the work area when closed. Reinforcing bars extending across the barrier give it added strength, and allow the barrier to aid in preventing a person or equipment from accidentally falling or passing through the barrier, thus enhancing safety. The reinforcing bars would also allow the barrier to prevent a robotic machine or other automated equipment from accidentally leaving the enclosed area. The rolling barrier also provides a physical barrier between the enclosed machine or area and the surrounding environment. Depending on the nature of the machine, the barrier can be formed of a variety of materials to offer protection from radiation, sparks, debris, heat and/or noise produced by the machine or process. At the same time, the rolling barrier may also be moved rapidly to an open position to allow the ingress or egress of materials or personnel. Additionally, the rolling barrier may be provided with other desirable safety features. For example, the rolling barrier may be provided with a detector for detecting when the barrier is in the fully closed position. The enclosed machine could be coupled to the detector such that it could not operate unless the barrier were fully closed. Further, any movement of the barrier away from the closed position could be sensed, and could trigger the enclosed machinery to cease operation. Accordingly, if an accidental impact to the barrier occurred, moving the barrier slightly away from the closed position, operation of the machine could cease thus helping to prevent any injury or damage to the personnel or object causing the impact. Other interconnections between the rolling barrier and the enclosed equipment could also be employed.

In accordance with the mentioned objects, and other objects and advantages, the rolling barrier of the invention comprises a curtain formed of fabric or other material that rolls onto and off of a tube preferably disposed above a doorway or opening to, respectively, block and unblock the opening. The edges of the curtain are received within guideways disposed laterally of the curtain, and which guide the curtain edges to maintain the curtain in a planar orientation during travel. Barricade members extending across the curtain (and thus the opening when the barrier is in the closed or blocking position) have their ends disposed in the guideways as well. The barricade members reinforce the curtain and are intended to prevent personnel or objects from passing through the opening at least when the barrier is in the closed position. The engagement between the ends of the barricade members and the guideways helps in providing this function. The barrier also includes a detector for detecting when the curtain is in or at least approaching the fully closed position. The detector may advantageously be coupled to other electronics to control or regulate operation of the enclosed machine.

The invention will be described herein in reference to the appended drawings, wherein:

DETAILED DESCRIPTION OF THE PREFERRED EMBODIMENTS

Figure 1:
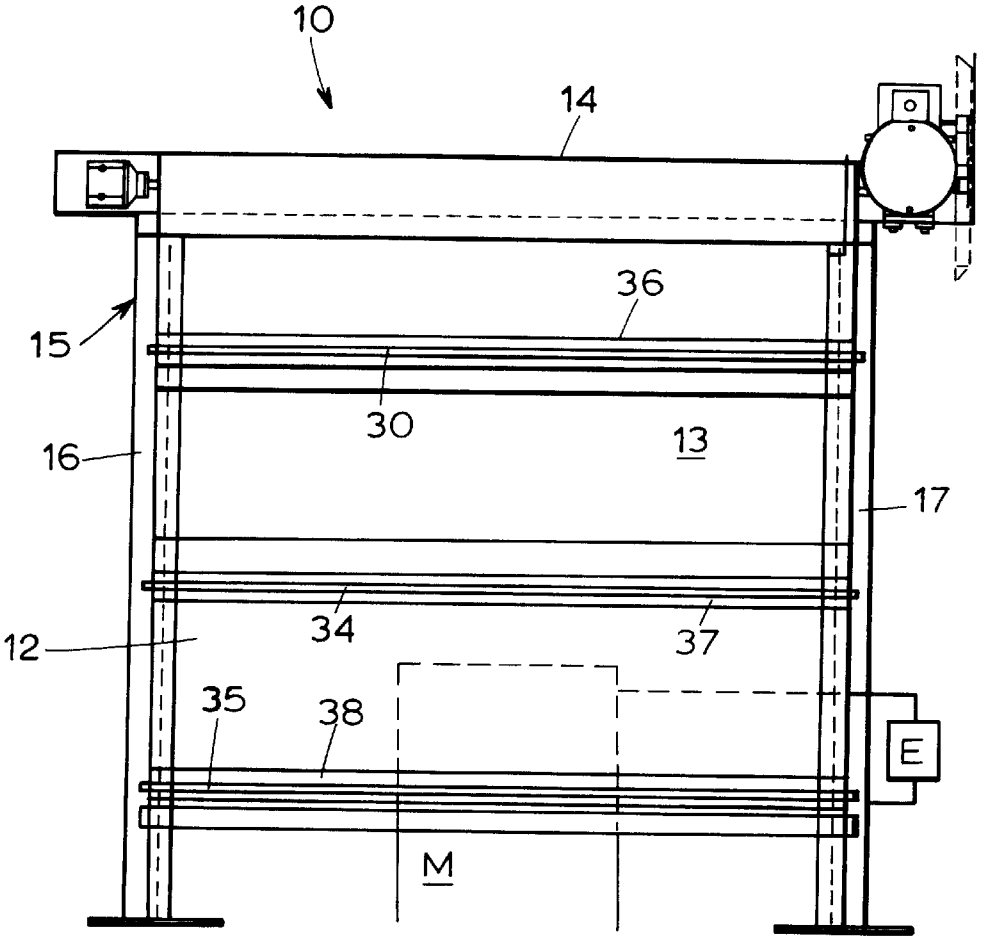
FIG. 1 is a front elevation of a rolling barrier according to one embodiment of the invention.
Figure 7:
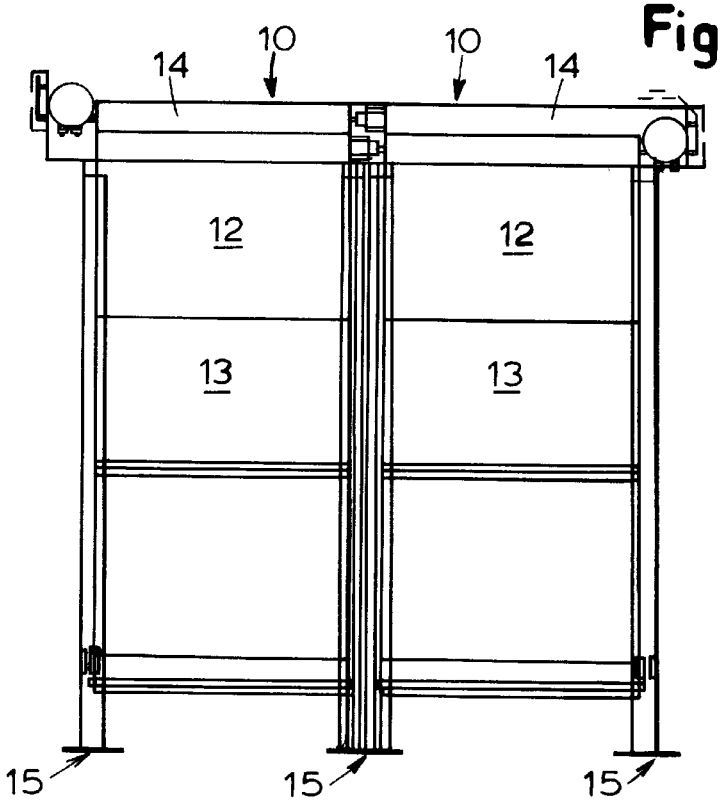
FIG. 7 is a front elevation view of a pair of rolling barriers according to the invention.

A rolling barrier 10 according to the invention is shown in FIG. 1. A side-by-side pair of barriers 10 is shown in FIG. 7. Illustratively, the rolling barrier 10 could be disposed adjacent an automated manufacturing machine (depicted in block form as M) to limit access to the machine during its operation. In such an arrangement, the equipment would typically be surrounded by non-moving walls, screens or curtains, with the enclosure having one or more openings or doors to allow selective access to the equipment. The rolling barrier 10 according to the invention would be associated with one or more of such openings. Alternatively, non-moving walls, screens or curtains could form a work-cell, with the rolling barrier 10 (one or more) serving as a "door" to allow ingress and egress from the work cell. Other environments for the rolling barrier according to the invention will be apparent to one of skill in the art. For ease of reference, the area to which the barrier of the invention limits access will be referred to herein as the "enclosed area" regardless of whether the barrier in combination with other structures actually encloses an area.

The roller barrier 10, according to the invention, includes a curtain 12, which is mountable on a roller 14, typically disposed above the doorway or opening with which the barrier 10 is associated. Depending on the nature of the process being carried out in the enclosed area, and the type of protection to be offered by the rolling barrier 10 (flying debris, sparks, radiation, etc.), a variety of coatings or additional fabric layers may be added to a base curtain fabric. Presently, the preferred base fabric is a heavy-duty nylon based fabric manufactured by Cooley, Inc. under Model No. LK50KU. For protection when welding is being performed in the enclosed area, a high-temperature fabric may be attached to the curtain, illustratively Southern Manufacturing's material, designated by Model No. S/10A120 Blue. For even higher temperature applications (if adjacent furnaces or the like), a Silica fabric can be added to the curtain, illustratively 34ST fabric from Ametek. A window, or vision panel 13 may also be included. A support structure 15 is associated with the barrier 10, and serves as a support for the roller 14. Illustratively, the support structure 15 is in the form of sideframe members 16, 17, and a header member 18. A motor assembly 20 is also mounted on the support structure, illustratively on or adjacent the header 18, for rotationally driving the roller 14. The curtain 12 is attached to the roller 14 such that it winds onto and off of the roller 14 as the roller is rotated by the motor 20. Accordingly, the curtain is movable between a doorway or opening blocking position, and a range of unblocking positions (as in FIG. 1), in which the curtain 12 is wound on the roller 14. A "range" of unblocking positions are referred to since the doorway will be partially exposed before the curtain 12 is completely wound on the roller 14. In the fully blocking position, the leading edge of curtain 12 may touch the floor.

To provide added stability to the curtain 12, and to allow the curtain to provide an effective barrier against accidental or unauthorized entry into the enclosed area, the curtain includes two or more reinforcing members disposed across the curtain. "Accidental or unauthorized entry" is intended to encompass entry into the enclosed area when it is undesirable or dangerous, such as when automated equipment is operating. It is this unauthorized or accidental entry which the barrier according to the invention is intended to prevent. One of the reinforcing members is illustratively in the form of a barricade bar 30. In the present embodiment, three barricade bars 30, 34, 35 are disposed at different heights along the curtain 12. Each barricade bar is in the form of a steel pipe, and is slightly longer than the width of the door opening (i.e the distance between the inner edges of the sideframes 16, 17). The ends of the barricade bars 30, 34, 35 are thus disposed within the sideframes 16, 17. Engagement between the ends of the bars 30, 34, 35 and the sideframes, 16, 17 prevents the bars from moving out of the plane of the curtain when it is in the blocking position. The bars 30, 34, 35 may be either coupled to or received within the curtain 12. In the present embodiment, the bars 30, 34, 35 are sewn into pockets 36, 37, 38 formed on the curtain.

In the blocking position, the curtain 12, as reinforced by the barricade bars 30, 34, 35, serves as a barrier to entry to the enclosed area. If personnel or equipment accidentally run into the curtain while it is in the blocking or other positions, the bars 30, 34, 35 engage the sideframes, thereby remaining in the plane of the opening (an imaginary plane substantially parallel to the plane of the curtain in the blocking position). Since the bars are coupled to the curtain, this action effectively prevents the curtain from leaving the plane of the opening, and thus prevents the equipment or personnel from entering the enclosed area.

Figure 2:
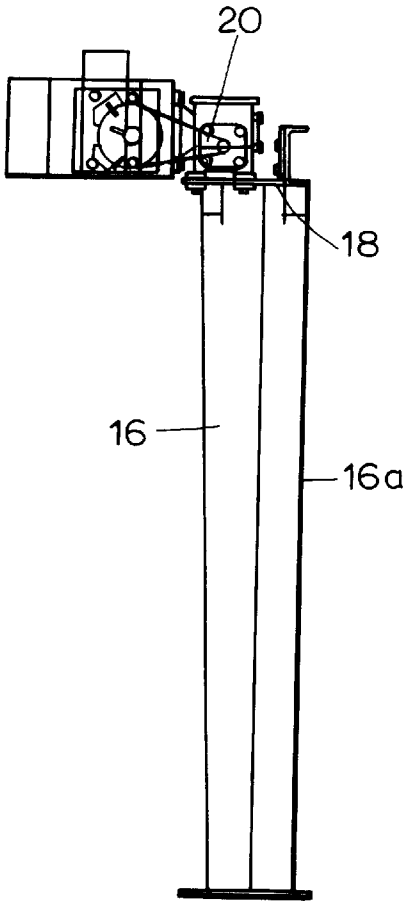
FIG. 2 is a side elevation of the barrier of FIG. 1.
Figure 3:
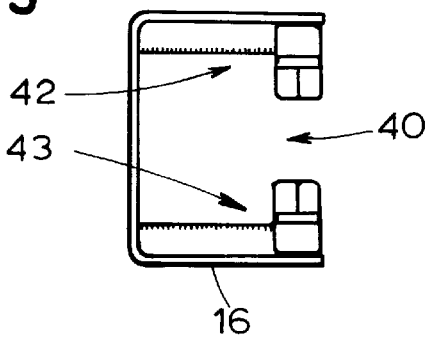
FIGS. 3 and 4 are top and side elevational views, respectively of a side frame of the rolling barrier of FIG. 1.
Figure 4:
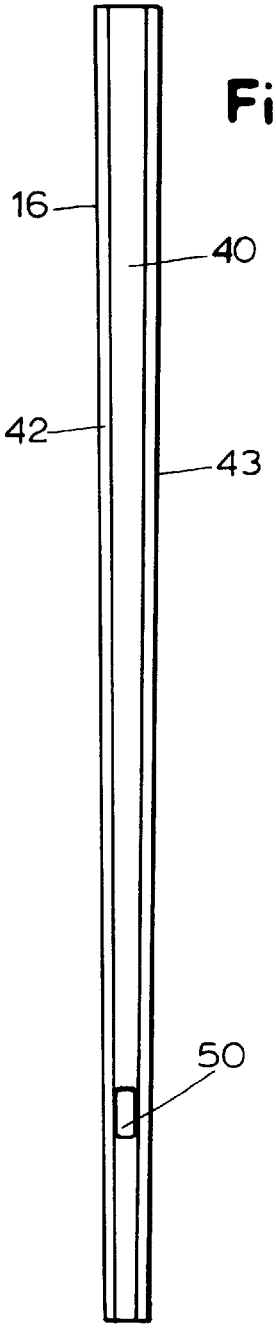

In order to receive and properly restrain the ends of the barricade bars 30, 34, 35 from moving out of the plane of the opening, the sideframes 16, 17 may have a generally u-shaped configuration, seen most clearly in FIG. 3. The "u" shape of the sideframes 16, 17 defines a slideway or central channel 40, within which the ends of the bars 30, 34, 35 ride. For impact forces on the curtain or the bars 30, 34, 35, the bars will engage the sidewalls 42 or 43 of the track 40. In the side view of FIG. 4, it can be seen that the sideframes 16, 17 may also taper from top to bottom such that the separation between the sidewalls decreases as the sideframes approach the floor. Also, as seen in FIG. 2, the sideframe may be attached for support to a support member such as 16*a*. The purpose of the taper is to eliminate unnecessary frictional drag between the curtain 12 and the sideframes 16, 17 while the curtain and bars are in the wider upper area of the sideframes. This reduced friction is desirable since the barrier according to the present invention falls largely by gravity to its closed position. At the same time, however, the sideframes 16, 17 taper to a narrower width at the bottom of the sideframe. Despite the possibility of increased friction in this area, the narrowing is desirable as it prevents the barrier in the blocking position from being able to move back and forth in the sideframes and helps maintain the barrier in the blocking position. In cases where the barrier 10 is serving as a barrier to sound or debris from inside the enclosed are, such prevention of back and forth movement is advantageous.

Figure 5:
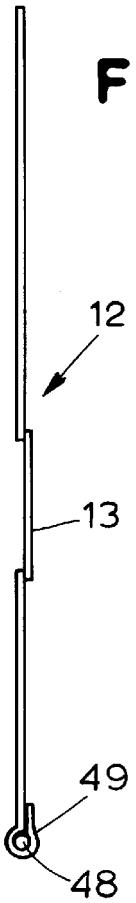
FIG. 5 is a side section view of the curtain forming a portion of the rolling barrier according to the invention.

Rolling barrier 10 also includes a leading edge member 48. The leading edge member adds weight to the curtain, which is an advantage as the barrier of the present embodiment falls by gravity. The member also helps provide a seal against the floor in the vicinity of the opening. While a rigid member could be used, the leading edge member of the present embodiment is deformable. In particular, leading edge member 48 is in the form of a tube of sand or ground garnet received within a loop 49 at the leading edge of the curtain, as seen most clearly in FIG. 5. Use of a deformable member like the sand bag allows the leading edge to deform about an obstacle or even personnel that may accidentally be encountered as the barrier moves toward the closing position, or indeed when it is anywhere in its travel.

Figure 6:
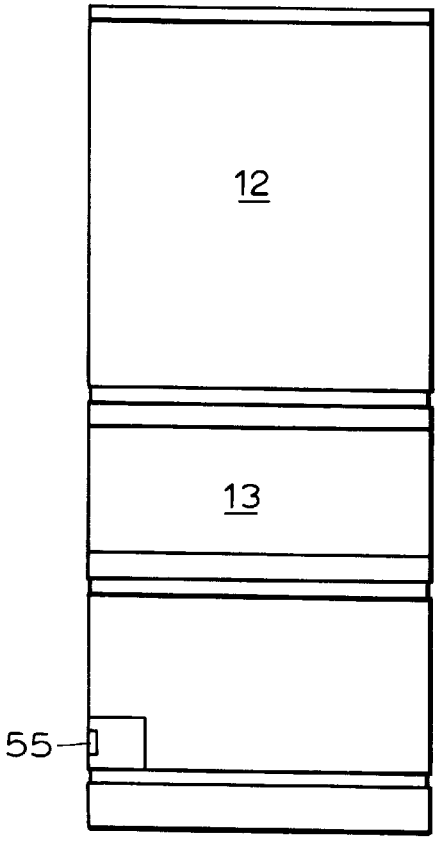
FIG. 6 is a front elevation view of the curtain showing FIG. 5.

To enhance the safety provided by the barrier 10, and to prevent accidents or unauthorized entry to the enclosed area from causing a hazardous condition, the barrier 10 may include a detector for determining when the barrier is in the blocking position. The detector may be coupled to the machine or apparatus M inside of the enclosed area to ensure that operation does not begin until the barrier is in the blocking position. At the same time, the detector can detect when the barrier moves away from the unblocking position—such as by being powered open, or by virtue of an accidental impact on the door. The coupling between the detector and the enclosed equipment or process could be used to stop the operation for movement of the barrier away from the blocking position. In the present embodiment, the detector 50 is a magnetic proximity switch manufactured by Sentrol under Model No. 301-CT-06K/12K. A magnet 55 is illustratively carried on the curtain 12 as seen in FIG. 6, and the switch 50 is mounted on the sideframe 16 at the location shown in FIG. 4. In this embodiment, the switch and magnet are mounted about 12 inches above the floor. The barrier assuming the blocking position causes the magnet 55 and the switch 50 to align, thus switching the state of the switch 50. Electronics E (represented by a functional block in FIG. 1) may be coupled to the switch 50 to detect the signal generated by the change in state of the switch 50. This signal may in turn be used to control operation of the process or equipment in the enclosed area (shown graphically by the connection between electronics E and machine M). For example, power to an enclosed automated manufacturing machine may only be applied when the barrier is fully closed, etc. When the barrier 12 is raised, or for an accidental impact on the curtain or the barricade bars, the magnet 55 and the switch 50 will become misaligned. This, in turn, will cause the switch 50 to again switch states. This switch in state may be detected by the electronics E to cease operation of the process or equipment in the enclosed area or otherwise control the enclosed process or equipment. Alternatively or additionally, lights could flash, horns could sound, etc. The electronics E could be any of a wide variety of components, from simple switches or relays to more complex PLC's or microprocessors, as will be apparent to one of skill in the art.

There has thus been disclosed a rolling barrier providing enhanced safety in the form of reinforcing barricade bars and a blocking position detector.

What is claimed is:

1. In an enclosed area having a machine therein through an opening defining a plane a rolling barrier for selectively limiting access to the enclosed area and being disposed adjacent the opening, the rolling barrier comprising:

a supporting structure disposed about the opening the supporting structure including sideframes disposed on opposite sides of the opening the sideframes including central channels each having a width that tapers down from top to bottom of the sideframes;

a roller mounted for rotation on the supporting structure and disposed above the opening;

a curtain coupled to the roller for movement between blocking and unblocking positions relative to the opening;

at least two reinforcing members coupled to and spaced along the curtain and including lateral ends, the lateral ends being received within the respective central channels to maintain the reinforcing member in the plane of the opening, whereby the curtain and reinforcing members are maintained in the plane of the opening for an impact on the curtain or the reinforcing member; and a detector for detecting when the curtain is in a blocking position and coupled to the machine such that the machine cannot operate until the detector detects the curtain is in the blocking position.

2. The rolling barrier of claim 1, wherein the reinforcing members are received within pockets on the curtain.

3. The rolling barrier of claim 1, wherein the curtain is formed of a nylon based material.

4. The rolling barrier of claim 3, wherein the curtain further comprises an additional layer of material.

5. The rolling barrier of claim 1 wherein the detector detects when the barrier is in a blocking position and detects when the barrier moves away from the blocking position, and generates signals in response thereto.

6. The rolling barrier according to claim 5, wherein the detector is a magnetic proximity switch, and a magnet is mounted on the curtain, such that the magnet and switch are aligned when the curtain is in the blocking position.

7. The rolling barrier according to claim 5, wherein the detector is coupled to the machine by a coupling including electronics responsive to the signals from the switch for controlling the machine.

8. In an enclosed area having a machine therein through an opening defining a plane a rolling barrier for selectively limiting access to the enclosed area and being disposed adjacent the opening of the rolling barrier comprising:

a supporting structure disposed about the opening and including sideframes disposed on opposite sides of the opening the sideframes including central channels each having a width that tapers down from top to bottom of the sideframes;

a roller mounted for rotation on the supporting structure and disposed above the opening;

a curtain coupled to the roller for movement between blocking and unblocking positions relative to the opening;

at least two reinforcing members coupled to and spaced along the curtain and including lateral ends, the lateral ends being received within respective central channels to maintain the reinforcing member in the plane of the opening; whereby the curtain and reinforcing members are maintained in the plane of the opening for an impact on the curtain or the reinforcing member; and a detector for determining the position of the door, and coupled to the machine, such that the position of the panel determines whether the machine may be operated.

* * * * *